US005641543A

United States Patent [19]

Brooks

[11] Patent Number: 5,641,543

[45] Date of Patent: Jun. 24, 1997

[54] COLORGALV GALVANIZING PROCESS

[75] Inventor: Richard L. Brooks, Wellesley, Mass.

[73] Assignee: Duncan Galvanizing Corp., Everett, Mass.

[21] Appl. No.: 514,932

[22] Filed: Aug. 14, 1995

[51] Int. Cl.[6] ..... B05D 3/12

[52] U.S. Cl. ..... 427/327; 451/39

[58] Field of Search ..... 427/327; 451/38, 451/39

[56] References Cited

U.S. PATENT DOCUMENTS 1,985,332 12/1934 Ward ..... 451/38

3,382,159 5/1968 Reed ..... 451/38

*Primary Examiner*—Katherine A. Bareford

*Attorney, Agent, or Firm*—Samuels, Gauthier, Stevens & Reppert

[57] ABSTRACT

Galvanized steel stock treated for the application of a finished coating or top coating. The galvanized steel is roughened with zinc pellets. The use of zinc pellets ensures that there are essentially no impurities in the treated zinc coating which would later form oxidation sites for corrosion.

8 Claims, 1 Drawing Sheet

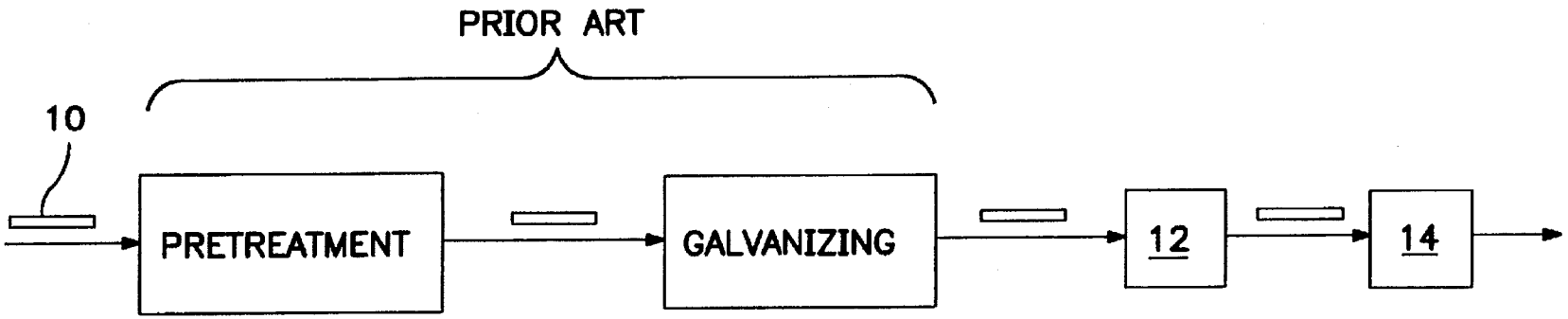
FIG. 1
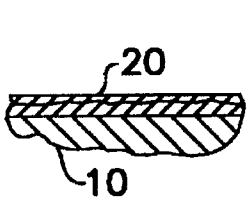
FIG. 2A
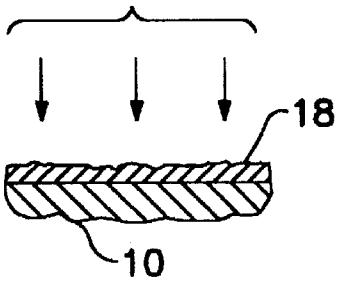
FIG. 2B
FIG. 2C
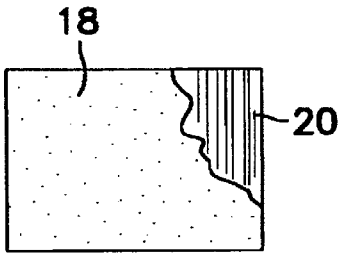
FIG. 3

COLORGALV GALVANIZING PROCESS

BACKGROUND AND BRIEF SUMMARY OF THE INVENTION

Corrosion resistance can be imparted to steel parts, such as beams, girders, fencing, Re-bar etc. by galvanizing, i.e. coating the steel with zinc or a zinc alloy. One conventional process for galvanizing steel is the hot dip process. The hot dip process usually requires a pre-treatment step to remove scale and rust before the steel is coated with the zinc or zinc alloy. This pre-treatment step improves the adhesion of the zinc coating to the steel strip. Typically, scale and rust are removed by dipping in a hydrochloric acid solution often followed by rinsing in water. Parts are then dipped in an aqueous flux solution containing zinc-ammonium chloride and, in some instances, sodium fluoride and/or potassium, nickel or cerium chloride.

In the galvanizing step, the steel is dipped in a bath of molten zinc. After leaving the bath, the zinc coating is substantially smooth.

Many commercial applications of galvanized steel require that an additional finish coating or top coating be applied over the zinc coating. These top coatings are both for their aesthetic appearance, i.e. provide a choice of color, and to provide a durable maintenance-free top coat.

The top coatings must be specially formulated to ensure good compatibility, adhesion and uniformity of appearance when applied to the zinc coating. Even where the fabricators are cognizant of this fact and use the proper coatings, the coatings will soon commence to peel and crack.

Many fabricators simply spray the top coating on the zinc coating with little or no surface preparation. Without proper surface preparation and depending upon the ambient environment, surface peeling and rusting will quickly commence.

Other fabricators pre-treat the zinc coating, typically by sandblasting, before application of the final coating. This serves to 'roughen' the surface. The roughened surface has an increased surface area to enhance the bonding of the coating to the zinc.

It has been found that with the prior art processes for preparing the zinc surface for the finished coating, typically by sandblasting, silica particles (impurities) become embedded in the zinc layer. These silica particles subsequently are oxidized and the oxidation reaction results in corrosion, i.e. cracking and peeling of the surface. That is, the prior art processes generally treat the zinc surface with materials which remain embedded in the zinc layer. These materials are impurities in the zinc coating and form oxidation sites which are the basis for the subsequent corrosion of the top coating.

The present invention is directed to a process for treating galvanized steel to prepare it for the application of a top coating. The process of the invention treats the surface of the zinc layer to 'roughen' the surface without embedding impurities into the zinc. The invention comprises a method for preparing the galvanized steel for the top coating, the galvanized steel so prepared and the galvanized steel as finally coated.

Broadly the invention comprises a method for preparing galvanized steel stock for the application of a top coating. As is understood in the art, for galvanized steel there are typically four layers in the zinc coating. A first eta ($\epsilon$) layer which interfaces with the steel surface, a zeta ($\zeta$) layer, a delta ($\Delta$) layer and then finally a gamma ($\gamma$) layer.

In the process of the invention, the zinc surface of the galvanized steel stock has at least an outer $\gamma$ layer and a $\Delta$ layer adjacent to the $\gamma$ layer. The invention in one aspect comprises treating the zinc coating with zinc pellets to remove the $\gamma$ layer from the zinc surface while roughening the $\Delta$ layer to provide a roughened grain-like surface. The coating is treated such that there is at least 15–40% more surface area available after treating than before. The roughness value (root-mean-square) is typically in the range of 1.5 to 4.0 μm. Further, the zinc treatment step and application of the top coating are effected while the zinc coating is still malleable, typically within twelve hours after the completion of the galvanizing step. Lastly, the process ensures there are no impurities in the treated zinc coating. As used in this disclosure 'impurities' comprise particles introduced into or formed in the zinc coating during the treatment step which particles would later form oxidation sites.

BRIEF DESCRIPTION OF THE DRAWINGS

FIG. 1 is a diagram of the process steps embodying the invention;

FIGS. 2A, 2B and 2C are an illustration of the formation of a finished surface of the invention; and FIG. 3 is an illustration of a coated treated surface after roughening.

DESCRIPTION OF THE PREFERRED EMBODIMENT

The present invention broadly embodies a galvanized coating process and particularly an architectural finish which provides more than twenty years of protection against more than 10% surface rust in an ambient environment, such as outdoor ornamental fence and railing. In a preferred embodiment the steel should contain carbon below 0.25%, phosphorous below 0.5% and manganese below 1.35%. The pre-treatment comprises steel members and assemblies that have been dipped utilizing a dry kettle process and a bath of molten zinc containing nickel and other state-of-the-art alloys designed to address the particular steel composition and to ensure homogeneous metallurgical growth and greater corrosion resistance in the hot dipped galvanizing process.

Within twelve hours of galvanizing, the coated surface is treated to impart to the surface a pebble-like or grain-like surface of substantial uniformity. A metallurgically compatible blasting material, specifically zinc pellets, are employed to remove the $\gamma$ outer layer and to form the pebble-like surface in the $\Delta$ layer. This ensures that in the preparation of the surface no impurities are incorporated into the layer which would later form a site for galvanic action (rusting).

Referring to FIG. 1, the steel stock 10 is pre-treated and galvanized according to prior art techniques. While the zinc coating is malleable, the steel stock then passes through a shot blasting machine 12 where zinc pellets impinge upon the surface of the zinc to remove the $\gamma$ layer and to roughen the $\Delta$ layer. A machine suitable for this step is a Wheelabrator shot blaster (Model WCRC-4).

Subsequently, while the treated zinc coating is still malleable it passes through a coating zone 14 where a top coating is applied. Typical liquid coatings suitable for purposes of the invention comprise polyamide epoxy primers and aliphatic polyurethane finish coats. The coatings can also comprise powder coatings. Collectively, these coatings are well known in the art and need not be described in detail.

Other than the fact that the treated steel stock passes through the coating zone while the zinc coating is malleable, the coating step, per se, is well known in the prior art. That is, the color of the coating, its composition and thickness are determined by specification.

The following illustrative and non-limiting example exemplifies the process of the invention. Steel stock, i.e. an 8' I beam is galvanized as shown in FIG. 1. The Δ and γ layers of the zinc coating are approximately 4–6 mills and the outer γ layer is approximately 2 mills and has a substantially smooth outer surface 16, see FIG. 2*a*. The steel member travels continuously through the shot blasting machine 12 at a rate of 2 ft/min. Pure zinc pellets impinge on the zinc surface to remove the γ layer and to treat the Δ layer 18, see FIG. 2*b*. The pellets typically impinge upon the surface at a velocity of 14,000–19,000 ft/min and a rate of approximately 30 lbs/min/amp/wheel.

The roughness profile of this treated surface is approximately 1.5–4 μm. Subsequently, and while the zinc coating is still malleable, a top coating is applied to the treated surface, see FIG. 2*c*.

A plan view of a treated coated surface is shown in FIG. 3.

It is well understood that depending upon the composition of the steel, the specific galvanizing process used, that the apparatus and method for treating the zinc surface will vary. This would also be consistent with the expected top coating to be applied. Where shot blasting is used, the size of the pellets can vary between 0.030 to 0.060 grit, the velocity of the pellets can vary between 14,000 to 19,000 ft/min and the rate of travel of the galvanized steel stock passing through the treatment zone can be varied.

It is possible that other metallurgically compatible particles can be used which would remain in situ in the treated coating but would not form oxidation sites.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described my invention, what I now claim is:

1. A process for treating galvanized steel to prepare it for the application of a top coating, the galvanized steel having a zinc coating having an outer γ layer and an inner Δ layer which comprises:

contacting a surface of the zinc coating with zinc pellets to remove the γ layer and to roughen the Δ layer to increase its surface area for bonding with a top coating, wherein the treated surface is essentially free of oxidation sites which would later form the basis for corrosion; and applying the top coat to said surface.

2. The process of claim 1 wherein the surface area of the Δ layer is 15–40% greater after being roughened.

3. The method of claim 1 which comprises:

roughening the surface while the zinc coating is still malleable.

4. The process of claim 3 which comprises:

applying the top coating while the zinc coating is still malleable.

5. The process of claim 1 wherein the top coating is selected from the group consisting essentially of polyamide epoxy primers, aliphatic polyurethane finish coats and powder coatings.

6. The process of claim 1 wherein the zinc pellets are between 0.030 to 0.060 grit.

7. The process of claim 1 wherein velocity of the pellets roughening the surface is between 14,000 to 19,000 feet per minute.

8. The process of claim 1 wherein the treated surface has a roughness value of between about 1.5 to 4.0 μm.

* * * * *